US005177535A

United States Patent [19]

Watanabe

[11] Patent Number: 5,177,535

[45] Date of Patent: Jan. 5, 1993

[54] IMAGE SCANNING APPARATUS HAVING ALIGNMENT CONFIRMATION MEANS

[75] Inventor: Junji Watanabe, Kanagawa, Japan

[73] Assignee: Kabushiki Kaisha Toshiba, Kawasaki, Japan

[21] Appl. No.: 687,735

[22] Filed: Apr. 19, 1991

[30] Foreign Application Priority Data

Apr. 25, 1990 [JP] Japan ..... 2-107381

[51] Int. Cl.[5] ..... G03G 21/00

[52] U.S. Cl. ..... 355/230; 271/245; 355/75; 355/231

[58] Field of Search ..... 355/230, 231, 75, 309, 355/43, 66, 44, 75, 60, 72, 76; 271/245

[56] References Cited

U.S. PATENT DOCUMENTS 4,875,075 10/1989 Sootome et al. ..... 355/75 X
5,016,045 5/1991 Watanabe ..... 355/66 X
5,054,768 10/1991 Iseda ..... 271/291
5,077,585 12/1991 Watanabe et al. ..... 355/231 X

*Primary Examiner*—A. T. Grimley
*Assistant Examiner*—Thu Dang
*Attorney, Agent, or Firm*—Foley & Lardner

[57] ABSTRACT

An image scanning apparatus for scanning an image on an image bearing member. The apparatus includes a platen glass for supporting an original having an image on a supporting surface, a platen sheet, movably mounted between a first position and a second position, for depressing the original against said supporting means, an image scanning device for scanning the image on the original along the supporting surface, an exposure command key for activating an activating device of the platen sheet to move from the first position to the second position so as to cause the platen sheet to expose the original and a depression command key for activating the activating device of the platen sheet to move from the second position to the first position so as to cause the platen sheet to depress the original against the platen glass.

18 Claims, 7 Drawing Sheets

IMAGE SCANNING APPARATUS HAVING ALIGNMENT CONFIRMATION MEANS

FIELD OF THE INVENTION

The present invention relates generally to an image scanning apparatus such as an electric copying machine.

BACKGROUND OF THE INVENTION

Conventionally, many developments have been made for image scanning apparatus such as an electronic copying machine. That is, many developments have been made in improving the quality of copy images, increasing the functions of the apparatus and making the handling of the apparatus easy. For example, there is known an image scanning apparatus which is able to automatically copy a plurality of single sheets of documents one after another.

In the conventional image scanning apparatus, an original carrying an image to be processed for copying or for other applications is fed to a predetermined position on an optical reader of the apparatus. In the automatic feeding of the original, the original is fed between the optical reader and a cover. In a manual feeding of the original, the original is placed on the optical reader and then covered by the cover. The cover holds the original on the copying position of the optical reader, during the processing of the original.

In such a conventional image scanning apparatus, the original frequently fails to be correctly aligned with the predetermined copying position. Further, it is difficult to confirm that the original is aligned in the correct copying position in the conventional apparatus. Thus, many faults of image forming frequently occur, e.g., faulty copies. This problem is particularly severe when automatic plural copying is carried out.

SUMMARY OF THE INVENTION

It is, therefore, an object of the present invention to provide an image scanning apparatus which allows an operator to easily confirm whether an image carrying original to be processed is correctly aligned with a predetermined position on an optical reader of the apparatus.

In order to achieve the above object, an image scanning apparatus according to one aspect of the present invention includes a platen glass for supporting an original having an image on a supporting surface, a platen sheet movably mounted between a first position and a second position, for depressing the original against said supporting means, an image scanning device for scanning the image on the original along the supporting surface, an exposure command key for activating an activating device of the platen sheet to move from the first position to the second position so as to cause the platen sheet to expose the original and a depression command key for activating the activating device of the platen sheet to move from the second position to the first position so as to cause the platen sheet to press the original against the platen glass.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
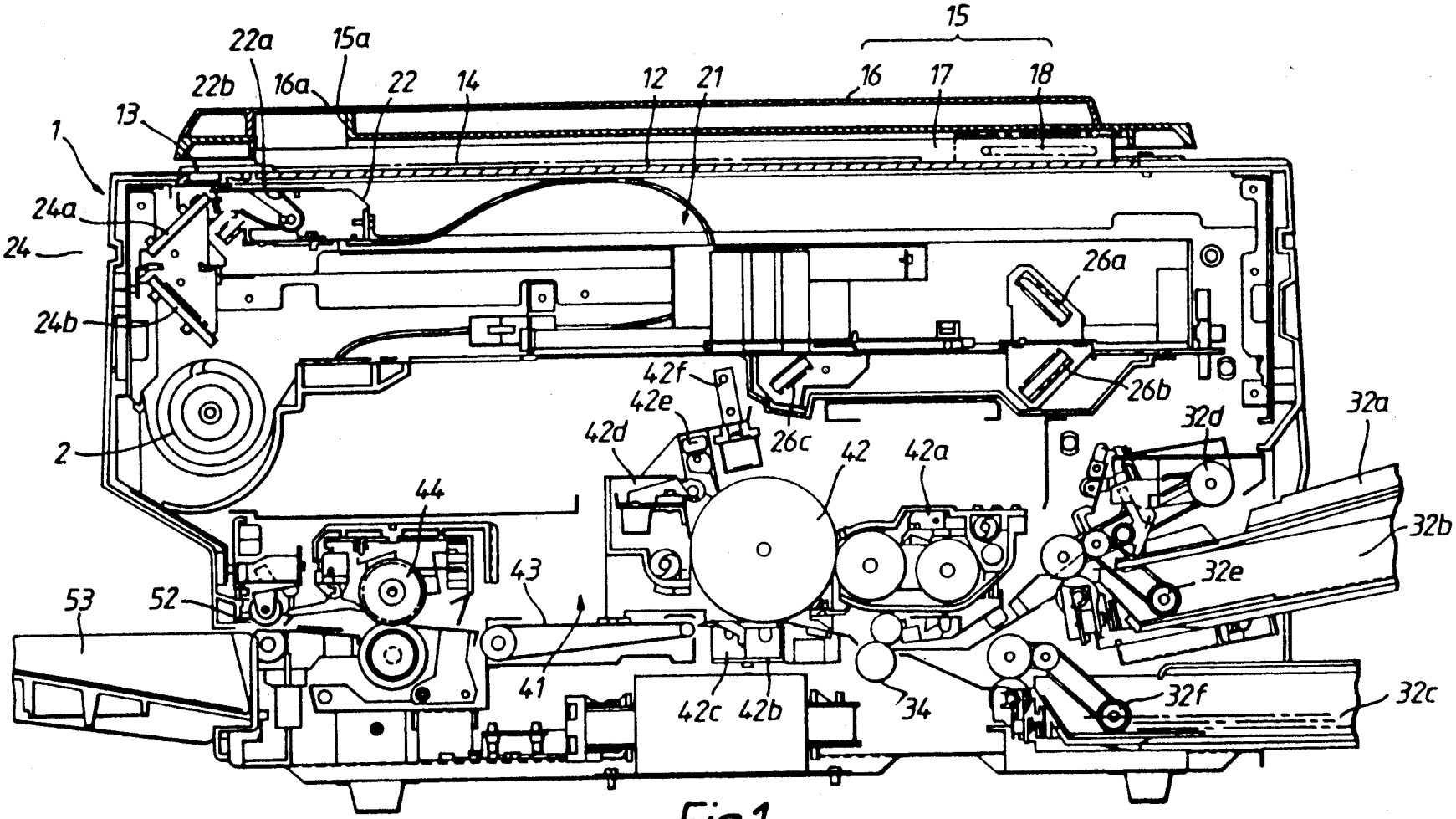
FIG. 1 is a longitudinal section of the image scanning apparatus according to the present invention.

The present invention will be described in detail with reference to the FIGS. 1 through 13. Throughout the drawings, like or equivalent reference numerals or letters will be used to designate like or equivalent elements for simplicity of explanation.

Referring now to FIG. 1, a general construction of the image scanning apparatus according to the present invention will be described in detail. In FIG. 1, the image scanning apparatus has a main body 1 for accommodating an image forming section 41 for copying an image of original document on an image carrying medium., similar to conventional image scanning apparatus. Details of the image forming section 41 will be described later.

On top of the main body 1, a platen glass 12 is mounted for laying thereon a sheet of original document 14 to be copied. The original document 14 is manually loaded or unloaded in regard to a predetermined copying position on the platen glass 12.

The predetermined copying position on the platen glass 12 is typically defined by a location regulating member 13 for locating the original document 14. The location regulating member 13 is fixed on the main body 1 at a position adjacent to the left end of the platen glass 12. The location regulating member 13 has a side wall 13*a* to which the left end of the original document 14 can fit. Thus, the original document 14 is correctly aligned to the predetermined copying position on the platen glass 12, by fitting the original document 14 to the side wall 13*a* of the location regulating member 13.

The image scanning apparatus is further provided with a platen cover 15 for stably holding the original document 14 on the platen glass 12. The details of the platen cover 15 will be described later.

The main body 1 is further provided with a pair of paper sheet storages 32*b* and 32*c* and a copied paper sheet receiving tray 53. The paper sheet storages 32*b* and 32*c* are removably fitted in openings defined in one side of the main body 1, while the copied paper sheet receiving tray 53 is removably fitted in an opening defined in the opposite side of the main body 1. The storages 32*b* and 32*c* store stacks of copy paper sheets with different sizes to each other. Further a temporary paper sheet tray 32*a* is fitted in the opening above the storages 32*b* and 32*c*. The tray 32*a* is used for temporarily feeding a copy paper sheet manually laid thereon.

A set of paper sheet loading devices are disposed in the main body 1 for selectively loading the paper sheet from a corresponding tray or storage to the image forming section 41. The paper sheet loading devices are equipped with takeup rollers 32*d*, 32*e* and 32*f*, respectively. The takeup rollers 32*d*, 32*e* and 32*f* take up a paper sheet P one by one from corresponding tray or storage. The paper sheet P thus taken up is loaded into the image forming section 41 through an aligning roller pair 34, thus the image of the original document 14 is copied on the paper sheet P.

The aligning roller pair 34 is disposed between a photosensitive drum 42 and the takeup rollers 32*d*, 32*e* and 32*f*. The paper sheet P thus carrying the image is unloaded to the copied paper sheet receiving tray 53 through an image fixing device 44 by a paper sheet unloading device 43 and a drive roller pair 52, which are disposed in the main body 1. The image fixing device 44 fixs the toner image on the paper sheet P.

The image forming section 41 comprises an optical exposure device 21 for optically scanning the original document 14 on the platen glass 12, the photosensitive drum 42, a charger 42*f*, an image developing device 42*a*, an image transfer unit 42*b*, a paper sheet releasing device 42*c*, a drum cleaning device 42*d*, a charge removing device 42*e*, etc., all equipped in the main body 1.

The photosensitive drum 42 is disposed in a generally central portion of the main body 1. The charger 42*f*, the image developing device 42*a*, the image transfer unit 42*b*, the paper sheet releasing device 42*c*, the drum cleaning device 42*d* and the charge removing device 42*e* are disposed around the photosentive drum 42 in the rotating direction thereof.

The charger 42*f* uniformly charges the surface of the photosensitive drum 42. The optical exposure device 21 applies the reflected light from the original document 14 on the platen glass 12 to the surface of the image of photosensitive drum 42 after the charger 42*f* has created a charge on the drum 42. Thus, the electric charge on the surface of the photosensitive drum 42 is removed, except for portions of the optical image of the original document 14. Details of the optical exposure device 21 will be described later.

The image developing device 42*a* applies toner particles on the surface of the photosensitive drum 42. Thus, a toner image is developed. The image transfer unit 42*b* transfers the toner image from the photosensitive drum 42 to the paper sheet P supplied by any one of the paper sheet loading devices. The paper sheet releasing device 42*c* releases the paper sheet carrying the toner image from the surface of the photosensitive drum 42. The drum cleaning device 42*d* cleans residual toner from the surface of the photosensitive drum 42. The charge removing device 42*e* removes residual charge from the photosensitive drum 42. Operation of the individual devices of the image forming section 41 are well-known in the art, so that details of their operation will be omitted.

As shown in FIG. 1, the optical exposure device 21 includes an optical scanning lamp 22*a*, whose rear portion is surrounded by a parabolic reflector 22*b* and which radiates light onto the original document 14 laid on the platen glass 12 and a set of mirrors, i.e., a first mirror 24*a*, a second mirror 24*b*, a third mirror 26*a*, a fourth mirror 26*b* and a fifth mirror 26*c*. The light emitted from the optical scanning lamp 22*a* is radiated to the original document 14 in an oblique direction by the parabolic reflector 22*b*, thus the light reflected from the original document 14 is applied to the first through fifth mirrors 24*a*, 24*b*, 26*a*, 26*b* and 26*c*, in turn.

The optical scanning lamp 22*a* and the parabolic reflector 22*b* are disposed on a first carriage 22 which travels along the platen glass 12 over the entire length of the platen glass 12 at a first speed. The first and second mirrors 24*a* and 24*b* are disposed on a second carriage 24 which travels along the platen glass 12 but over only half the distance, and at half the speed of the first carriage 22.

The first and second carriages 22 and 24 move in synchronism with each other, rightwardly in the drawing of FIG. 1 for optically scanning the original document 14 on the platen glass 12, as shown by dotted lines in the drawing.

The third through fifth mirrors 26*a*, 26*b* and 26*c* are stationarily disposed in the main body 1 for applying the reflected light from the second mirror 24*b* to the image forming section 41.

The main body 1 further includes a cooling device 2, such as a fan.

Figure 2:
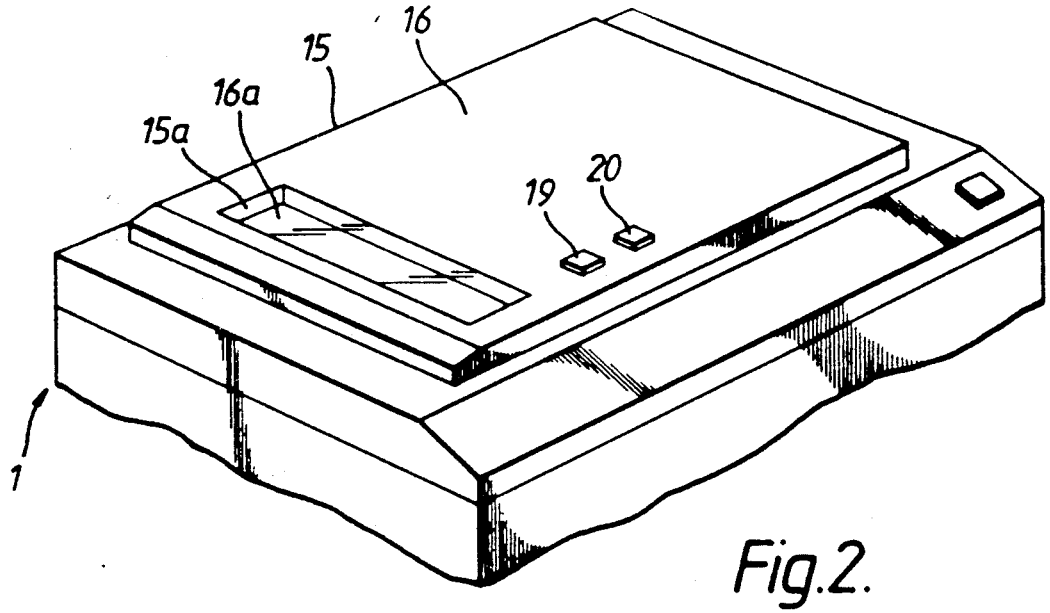
FIG. 2 is a perspective view showing the platen cover of FIG. 1 in a lowered position on the main body.
Figure 3:
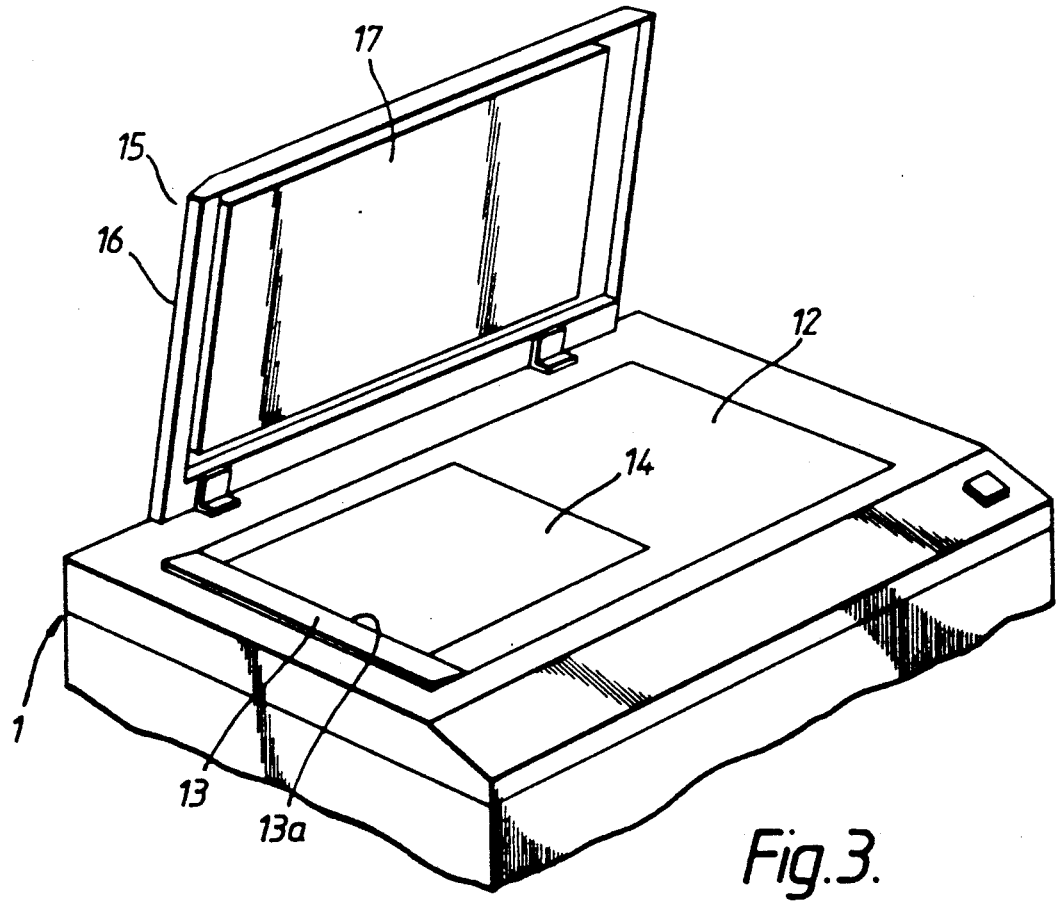
FIG. 3 is a perspective view showing the platen cover of FIG. 1 in a raised position from the main body, where the platen sheet is in a first position ready to depress an original document against the platen glass.
Figure 4:
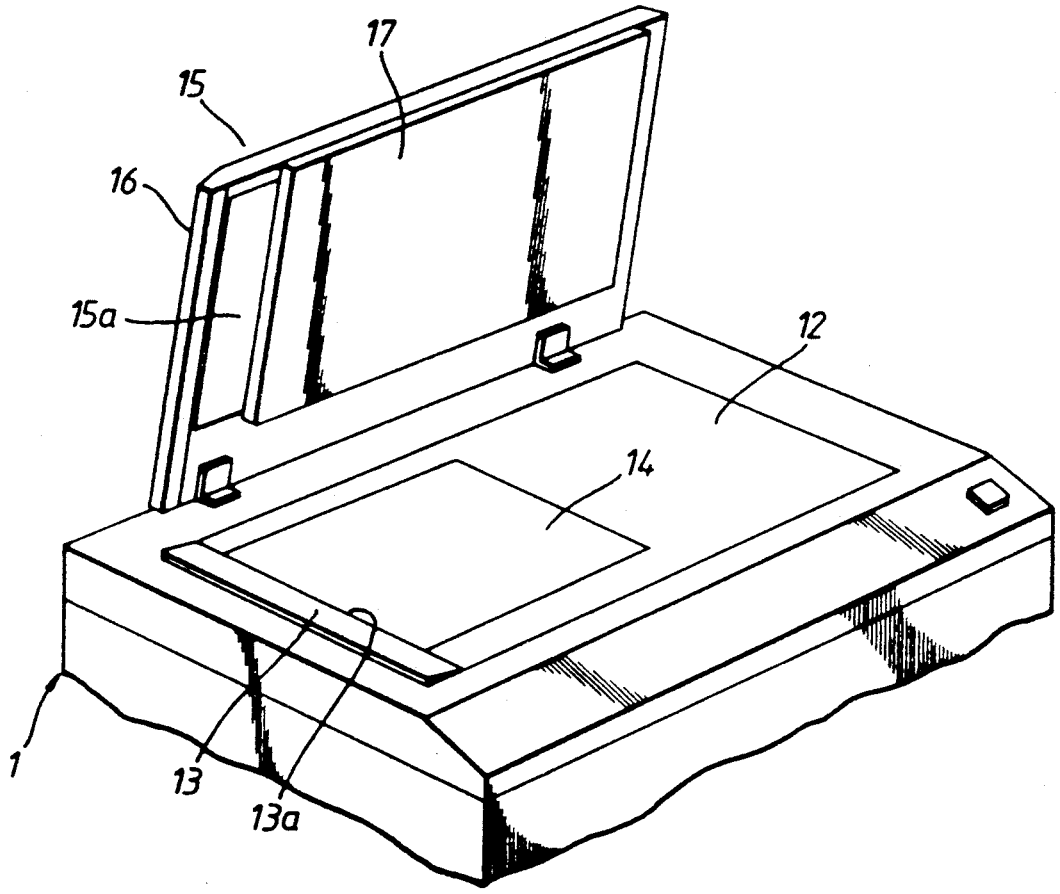
FIG. 4 is a perspective view showing the platen cover of FIG. 1 in the raised position from the main body, where the platen sheet is in a second position ready to expose an original document against the platen glass.

Referring now to FIGS. 2, 3 and 4, the platen cover 15 includes a cover body 16, a platen sheet 17 and a platen sheet activating device 18. The platen cover 15 houses the platen sheet 17 and the platen sheet activating device 18 so that the platen sheet 17 is movably supported in the cover body 16 by the platen sheet activating device 18. The details of the platen sheet activating device 18 will be described later. The platen sheet 17 comprises a base sheet 17*a* and a white sheet 17*b* fitted on the base sheet 17*a*. The white sheet 17*b* has a slippery surface which faces the platen glass 12. Further, the platen cover 15 includes a depression command key 19 and an exposure command key 20.

The cover body 16 is provided with a window 15*a* through which an operator can view the platen glass 12, as shown in FIG. 2. Typically, the window 15*a* is covered by a transparent glass 16*a* fitted to the cover body 16.

The platen sheet 17 is slidably mounted in the cover body 16 so that the window 15*a* is selectively covered by the platen sheet 17, as shown in FIGS. 3 and 4.

FIG. 3 shows a first position of the platen sheet 17 in that the platen sheet 17 has been slid leftwardly (in the drawing) so that it is ready to depress an original document 14 supported on the platen glass 12 and covers the window 15*a*. In this first position, the platen cover 15 can stably depress or hold the original document 14, when the platen cover 15 is lowered onto the platen glass 12.

FIG. 4 shows a second position of the platen sheet 17 in that the platen sheet 17 has been slid rightwardly (in the drawing) so that it is ready to expose the original document 14 and uncover the window 15*a*. In this second position, an operator can view the platen glass 12 or the original document 14 placed on the platen glass 12 through the window 15*a* as well as a part of the location regulating member 13, i.e. the portion of the side wall 13*a*, when the platen cover 15 is lowered down on the platen glass 12. In this second position, the operator is allowed to view a part of the location regulating member 13, i.e., the portion of the side wall 13*a* and the portion of the platen glass 12 adjacent to the location regulating member 13. Thus, the operator can confirm whether the original document 14 is correctly aligned to the predetermined copying position on the platen glass 12.

Figure 5:
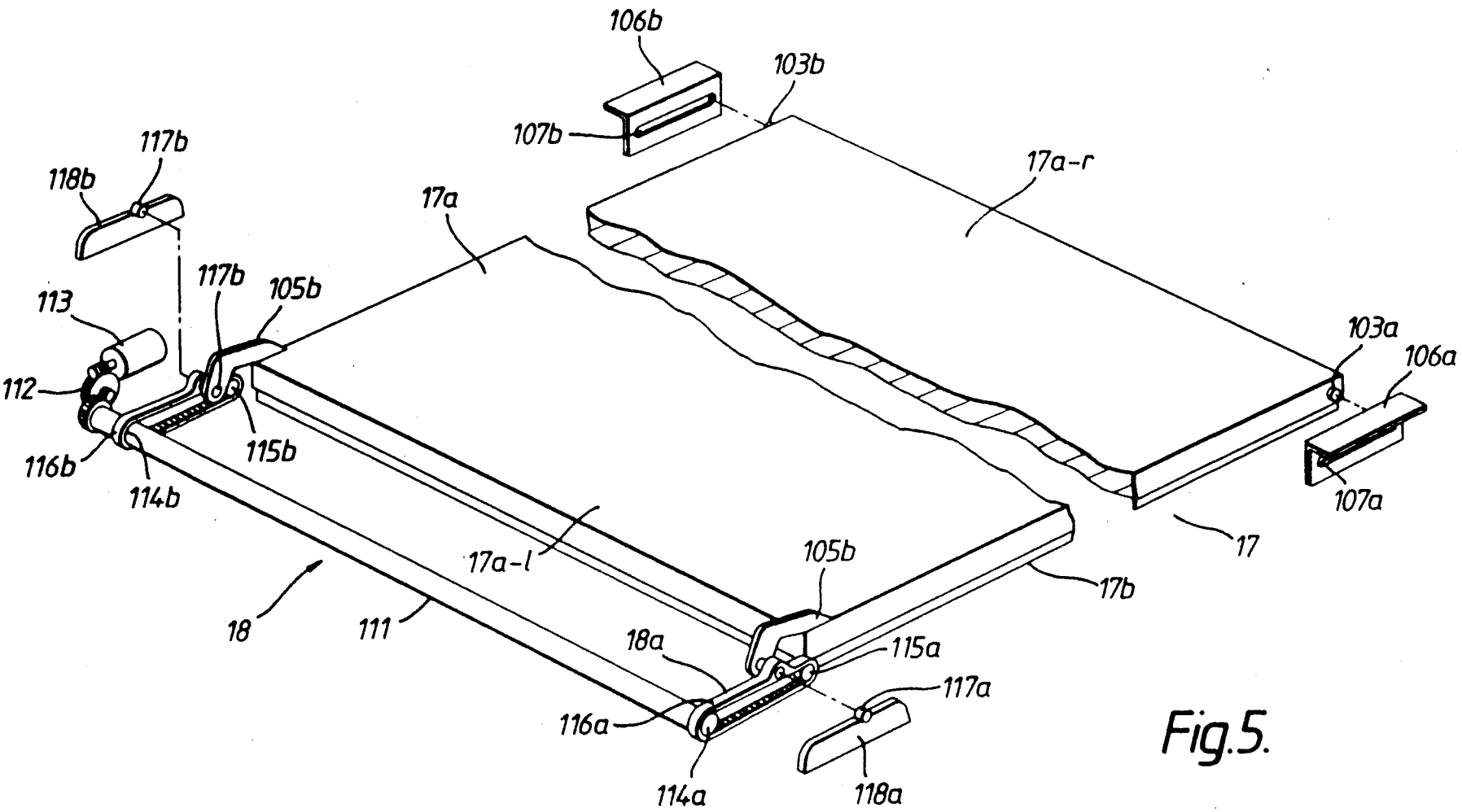
FIG. 5 shows a perspective view showing a platen sheet activating device.
Figure 6:
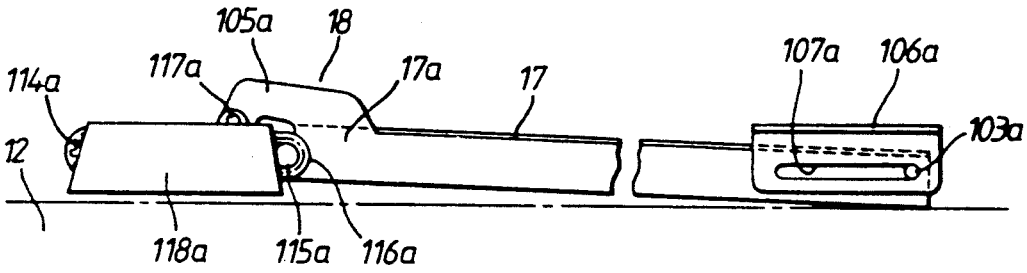
FIGS. 6, 8 and 10 are front views showing several positional states of the platen sheet activating device of FIG. 5.
Figure 7:
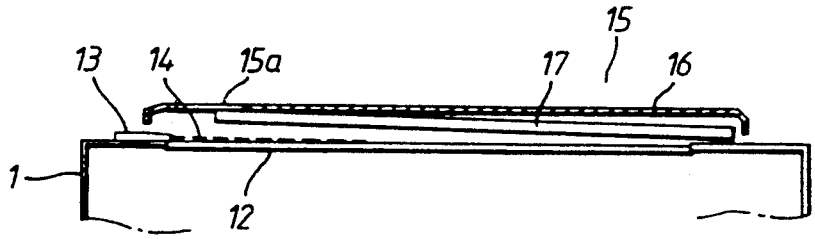
FIGS. 7, 9 and 11 are sections showing several positions of the platen cover in regard to an original document to be copied.
Figure 8:
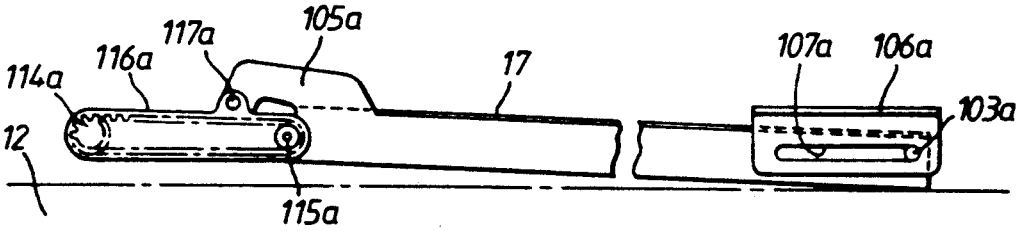

Referring now to FIGS. 5 through 8, the platen sheet activating device 18 will be described. FIG. 5 shows a perspective view of the platen sheet activating device 18 which is assembled in the cover body 16 (not shown in the drawing, see FIG. 3). FIGS. 6, 7 and 8 show side views of the platen sheet activating device 18 in several operating steps.

In FIG. 5, the rightward end of the base sheet 17*a* of the platen sheet 17 is supported by the cover body 16 through a pair of pins 103*a*, 103*b* and a pair of slot guide members 106*a*, 106*b*. The pins 103*a*, 103*b* are mounted on the front and rear side walls of the rightward end 17*a–r* of the base sheet 17*a*, respectively. The slot guide members 106*a*, 106*b* are mounted on the front and rear inside walls of the cover body 16, respectively. The slot guide members 106*a*, 106*b* have slots 107*a*, 107*b* for slidably supporting the pins 103*a*, 103*b*.

The leftward end of the base sheet 17*a* is supported by the cover body 16 through the platen sheet activating device 18. In the platen sheet activating device 18, a drive shaft 111 is driven by a motor 113 through a gear array 112. The drive shaft 111 is rotatably supported in the cover body 16. The drive shaft 111 is provided with a pair of drive pulleys 114*a*, 114*b* for driving a pair of timing belts 116*a*, 116*b*, respectively. Further, a pair of follower pulleys 115*a*, 115*b* are rotatably supported in the cover body 16. These drive pulleys 114*a*, 114*b* and the follower pulleys 115*a*, 115*b* are coupled with each other through a pair of the timing belts 116*a*, 116*b*, respectively.

The timing belts 116*a*, 116*b* are provided with cam follower pins 117*a*, 117*b*, respectively. The cam follower pins 117*a*, 117*b* are coupled to a pair of links 105*a*, 105*b* which are fixed to the front and rear side walls of the leftward end 17*a–l* of the base sheet 17*a*, respectively. The cam follower pins 117*a*, 117*b* are further engaged with a pair of stationary cams 118*a*, 118*b* which are fixed to the cover body 16, respectively The stationary Cams 118*a*, 118*b* have approximately a trapezoid shape.

Figure 9:
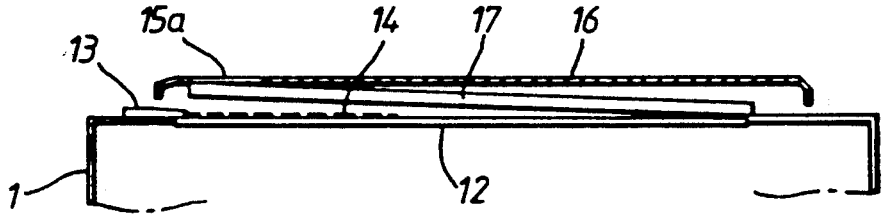
Figure 10:
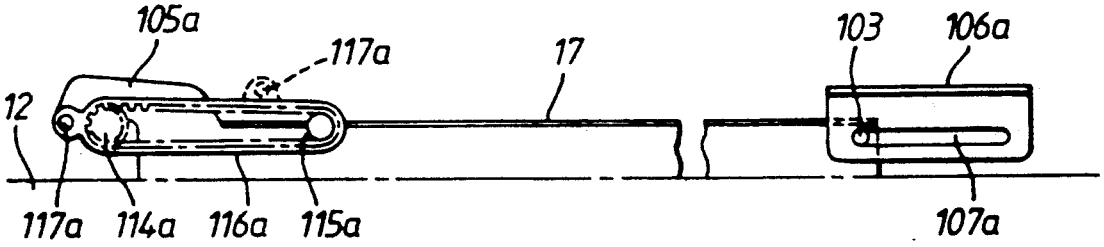
Figure 11:
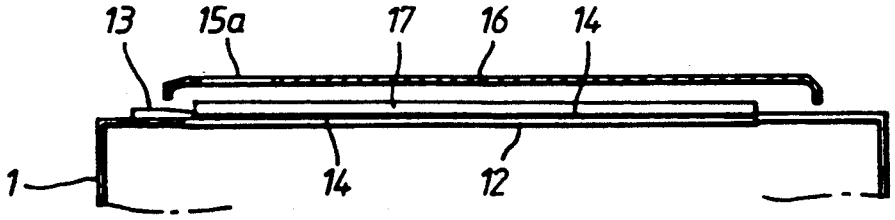

Referring now to FIGS. 6 through 11, the operation of the platen sheet activating device 18 will be described. Here, FIGS. 6, 8 and 10 show the front views of several positional states of the platen sheet 17 and the cam follower pins 117*a*, 117*b* of the platen sheet activating device 18. While FIGS. 7, 9 and 11 show the sections of several operating states of the platen cover 15 in regard to an original document 14 laid on the platen glass 12 of the main body 1.

When the platen sheet 17 stays in the rightmost position, the cam follower pins 117*a*, 117*b* engage with the top cam surfaces of the stationary cams 118*a*, 118*b*, as shown in FIG. 6. This position of FIG. 6 corresponds to the uncovering state shown in FIG. 4. In this position, the pins 103*a*, 103*b* mounted on the rightward end 17*a–r* of the platen sheet 17 stay in the right end or the neighborhood of the slots 107*a*, 107*b* of the slot guide members 106*a*, 106*b*, respectively. The cam follower pins 117*a*, 117*b* coupled to the leftward end 17*a–l* of the platen sheet 17 through the links 105*a*, 105*b* stay on the rightward portions of the top cam surfaces of the stationary cams 118*a*, 118*b* (shown by a dotted line), respectively. Thus, the leftward end 17*a–l* of the platen sheet 17 stays in a raised position. In other words, the platen sheet 17 is rocked in the clockwise direction. In this uncovering state, the platen sheet 17 is detached from the original document laid on the platen glass 12 when the platen cover 15 is lowered down on the platen glass, as shown in FIG. 7.

When an operator operates the depress command key 19 (see FIG. 2) for obtaining the first position of the platen sheet 17, the motor 113 drives the drive shaft 111 to rotate in the counterclockwise direction through the gear array 12. The drive shaft 111 drives the timing belts 116*a*, 116*b* through the driver pulleys 114*a*, 114*b*. Then the cam follower pins 117*a*, 117*b* reach the left end cam surfaces of the stationary cams 118*a*, 118*b* (shown by a dotted line), respectively, as shown in FIG. 8. The platen sheet 17 moves toward the left end of the platen glass 12 so that the platen sheet 17 reaches a third position above its first position and covers the window 15*a*. Until the cam follower pins 117*a*, 117*b* reach the left ends of the top cam surfaces of the stationary cams 118*a*, 118*b*, the platen sheet 17 is kept in the rocked position. Thus, the platen sheet 17 is still detached from the original document laid on the platen glass 12, as shown in FIG. 9.

The cam follower pins 117*a*, 117*b* are further driven in the leftward direction, so that the cam follower pins 117*a*, 117*b* lower down along the left end cam surfaces of the stationary cams 118*a*, 118*b*, as shown in FIG. 10, respectively. Thus, the leftward end 17*a–l* of the platen sheet 17 is lowered down and laid on its first position. In other words, the platen sheet 17 rocks in the counterclockwise direction. In this first position, the platen sheet 17 depresses the original document 14 against the platen glass 12, as shown in FIG. 11.

On the other hand, when them operator operates the exposure command key 20 (see FIG. 2) for obtaining the second position of the platen sheet 17, the motor 113 drives the drive shaft 111 to rotate in the clockwise direction through the gear array 12. As a result, the activating device 18 finally moves the platen sheet 17 to its second position, as shown in FIGS. 4 and 7.

Figure 12:
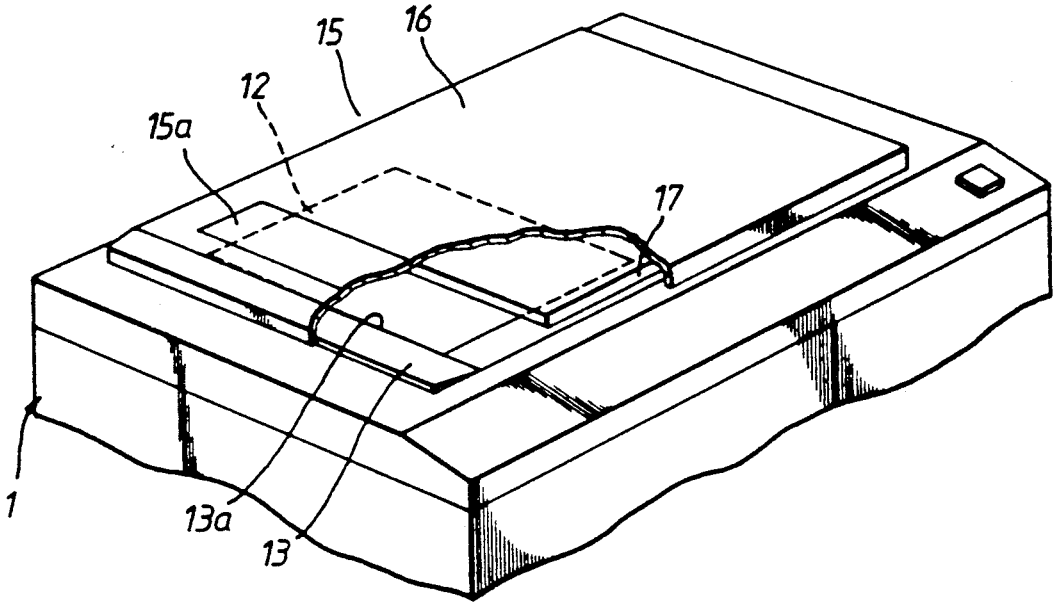
FIGS. 12 and 13 are perspective views for explaining the effect of the image scanning apparatus according to the present invention.
Figure 13:
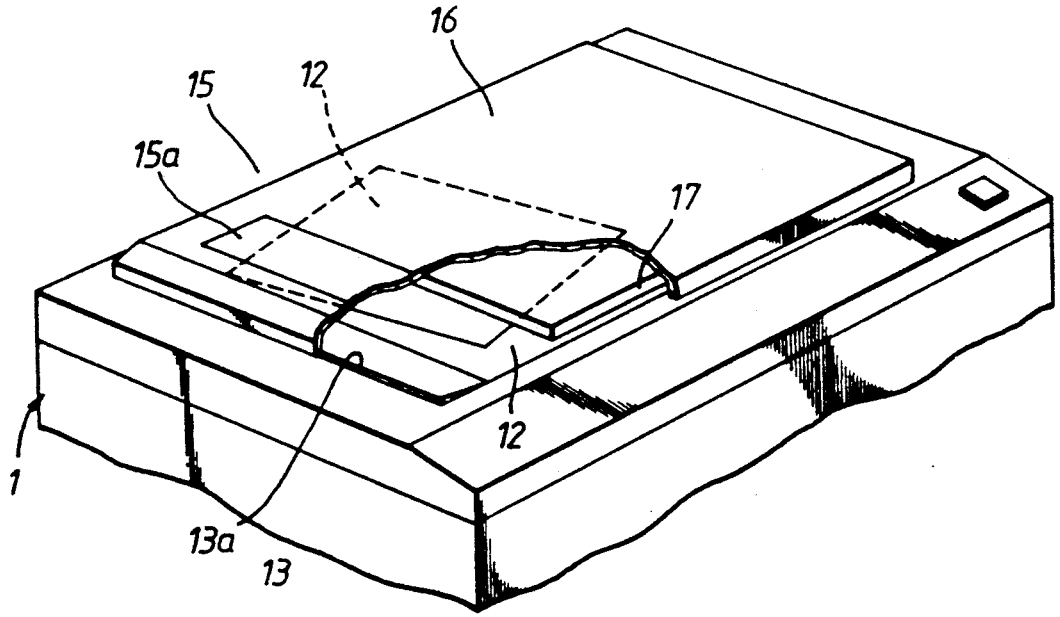

According to the embodiment Of the image scanning apparatus, an operator can operate the depression command key 19 or the exposure command key 20 to move the platen sheet 17 to the first position or the second position, thus, for depressing or exposing the original document 14 supported on the platen glass 12. This also causes the platen sheet 17 to cover or uncover the window 15*a*. Thus, the operator can easily confirm whether the original document 14 is correctly aligned to the predetermined copying position on the platen glass 12, as shown in FIG. 12, or not aligned to the predetermined copying position on the platen glass 12, as shown in FIG. 13. When it has been confirmed that the original document 14 is correctly aligned to the predetermined copying position, the platen sheet 17 is moved to its first position for depressing the original document 14 against the platen glass 12.

The platen sheet activating device can be realized by a variety of conventional devices, other than or together with the timing belt as described above. For instance, gear devices, lever devices, solenoid plungers, etc., can be used for the platen sheet driving device. Further, the platen sheet activating device can be constituted for the activation by manual forces. Further, the window does not always need the transparent glass.

As described above, the present invention can provide an extremely preferable image scanning apparatus.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

I claim:

1. An image scanning apparatus, comprising:

means for supporting an original, having an image, on a supporting surface;

means for covering said supporting means, the covering means defining an open housing and means for viewing the original on said supporting means from outside of the covering means, the open housing being closed by said supporting means when placed on said supporting means and the viewing means corresponding to a prescribed portion of said supporting means;

means, mounted in the open space of the covering means movably between a first position and a second position, for depressing the original against said supporting means;

means for scanning the image on the original along said supporting surface;

first moving means for moving said depressing means from the first position to the second position so as to cause said depressing means to be separated from said supporting means and also to expose the original through the viewing means when said covering means covers said supporting means; and second moving means for moving said depressing means from the second position to the first position so as to cause said depressing means to depress the original against said supporting surface and also to close the viewing means against the original when said covering means covers said supporting means.

2. An image scanning apparatus as in claim 1, further comprising means for activating the movement of said depressing means between the first position and the second position.

3. An image scanning apparatus as in claim 2, further comprising means for manually commanding the activating means to cause an activating operation.

4. An image scanning apparatus as in claim 2, wherein said activating means includes first means for shifting said depressing means in a first direction parallel to said supporting surface and second means for shifting said depressing means in a second direction vertical to the surface of said supporting surface.

5. An image scanning apparatus as in claim 4, wherein said activating means includes a cam on which is defined a first cam surface for causing a parallel movement of said depressing means and a second cam surface for causing a vertical movement of said depressing means.

6. An image scanning apparatus as in claim 1, wherein said depressing means has a surface for depressing the entire surface of the original when said depressing means is in the second position.

7. An image scanning apparatus as in claim 1, further comprising means for moving said depressing means between the first position, at which said depressing means depresses the original against said supporting means, and a position at which said depressing means separates from the original supported on said supporting means.

8. An image scanning apparatus as in claim 1, further comprises means for regulating movement of the original in a specific direction parallel to the supporting surface.

9. An image scanning apparatus, comprising:

means for supporting an original, having an image, on its supporting surface;

means for scanning the original along the supporting surface of said supporting means;

means, openably arranged around said supporting means, for covering the supporting surface of said supporting means;

means, movably mounted in said covering means, for depressing the original against the supporting surface of said supporting means;

means for moving said depressing means in relation to said covering means between a first position for causing said depressing means to depress the original against the supporting surface of said supporting means and a second position separate from the first position for causing said depressing means to expose the original supported on the supporting surface of said supporting means while said covering means covers the supporting surface of said supporting means; and means for commanding said moving means to cause the moving operation.

10. An image scanning apparatus as in claim 9, wherein said moving means includes first means for shifting said depressing means in a first direction parallel to said supporting surface and second means for shifting said depressing means in a second direction vertical to the surface of said supporting surface.

11. An image scanning apparatus as in claim 10, wherein said moving means includes a cam on which is defined a first cam surface for causing the parallel shifting of said depressing means and a second cam surface for causing the vertical shifting of said depressing means.

12. An image scanning apparatus as in claim 9, wherein said depressing means has a surface for depressing the surface of the original when said depressing means is in the second position.

13. An image scanning apparatus as in claim 9, further comprising means for moving said depressing means between the first position, at which said depressing means depresses the original against said supporting means, and a position at which said depressing means separates from the original supported on said supporting means.

14. An image scanning apparatus as in claim 9, further comprising means for regulating movement of the original in a specific direction parallel to the supporting surface.

15. An image scanning apparatus, comprising:

a platen glass for supporting an original having an image thereon, said platen glass having a supporting surface, and a regulating portion for regulating a movement of the original in a specific direction parallel to the supporting surface;

an image scanning device for scanning the image on the original supported on the supporting surface of said platen glass;

a cover body for covering said platen glass, the cover body defining an open housing and a window, the open housing being closed by said platen glass when placed on said platen glass and the window corresponding to a prescribed portion of said platen glass when said cover body covers said platen glass;

a platen sheet, movably mounted in said housing of the cover body, for depressing the original against the supporting surface of said platen glass when said cover body covers said platen glass; and an activating device for activating said platen sheet in relation to said cover body between a first position for causing said platen sheet to depress the original against the supporting surface of said platen glass and also to close the window against the original and a second position separate from the first position for causing said platen sheet to expose the original supported on the supporting surface of said platen glass through the window while said cover body covers the supporting surface of said platen glass, said activating device including a device for moving said platen sheet in the specific direction when said activating device activates said platen sheet from the second position to the first position.

16. An image scanning apparatus as in claim 15, wherein said moving device includes a cam member for shifting said platen sheet in a first direction parallel to said supporting surface and a belt drive for shifting said platen sheet in a second direction vertical to the surface of said platen glass.

17. An image scanning apparatus as in claim 16, wherein said cam member includes a cam which defines a first cam surface for causing the parallel shifting of said platen sheet and a second cam surface for causing the vertical shifting of said platen sheet.

18. An image scanning apparatus as in claim 15, wherein said platen sheet has a surface for depressing the surface of the original when said platen sheet is in the second position.

* * * * *